US011048199B2

(12) United States Patent
Miyagawa

(10) Patent No.: US 11,048,199 B2
(45) Date of Patent: Jun. 29, 2021

(54) IMAGE FORMING APPARATUS

(71) Applicant: KYOCERA Document Solutions Inc., Osaka (JP)

(72) Inventor: Tomoo Miyagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 380 days.

(21) Appl. No.: 16/022,747

(22) Filed: Jun. 29, 2018

(65) Prior Publication Data

US 2019/0018356 A1 Jan. 17, 2019

(30) Foreign Application Priority Data

Jul. 12, 2017 (JP) ..... JP2017-135898

(51) Int. Cl.
*G03G 15/00* (2006.01)
*G03G 21/16* (2006.01)

(52) U.S. Cl.
CPC ..... *G03G 15/602* (2013.01); *G03G 15/6502* (2013.01); *G03G 21/1633* (2013.01)

(58) Field of Classification Search
CPC ..... G03G 21/1633; G03G 21/1638; G03G 21/1628; G03G 21/1647; B65H 2402/44; B65H 2402/441
See application file for complete search history.

(56) References Cited

U.S. PATENT DOCUMENTS 7,246,963 B2 7/2007 Nishimura
9,778,597 B2 10/2017 Eto
2002/0150404 A1* 10/2002 Matsuzaka ..... G03G 21/1853 399/111
2005/0141947 A1 6/2005 Nishimura
2009/0175648 A1* 7/2009 Tsuchiya ..... G03G 21/1633 399/107
2017/0075258 A1 3/2017 Eto

FOREIGN PATENT DOCUMENTS

JP 2005-195704 A 7/2005
JP 2017-054023 A 3/2017

OTHER PUBLICATIONS

An Office Action; "Notice of Reasons for Refusal," mailed by the Japanese Patent Office dated May 11, 2021, which corresponds to Japanese Patent Application No. 2017-135898 and is related to U.S. Appl. No. 16/022,747; with English language translation.

* cited by examiner

*Primary Examiner* — Jennifer Bahls
*Assistant Examiner* — Quang X Nguyen
(74) *Attorney, Agent, or Firm* — Studebaker & Brackett PC

(57) ABSTRACT

An image forming apparatus includes an image forming section a casing, and an open-close section. The image forming section forms an image on a sheet. The casing internally houses the image forming section. The casing includes a first opening formed in a front surface of the casing and a second opening formed in an upper surface of the casing. The open-close section includes a first cover, a second cover, and an interlocking section. The first cover includes a first cover main body that opens and closes the first opening. The second cover includes a second cover main body that opens and closes the second opening. The interlocking section opens the second cover main body as the first cover main body is opened.

8 Claims, 5 Drawing Sheets

IMAGE FORMING APPARATUS

INCORPORATION BY REFERENCE

The present application claims priority under 35 U.S.C. § 119 to Japanese Patent Application No. 2017-135898, filed on Jul. 12, 2017. The contents of this application are incorporated herein by reference in their entirety.

BACKGROUND

The present disclosure relates to an image forming apparatus.

An image forming apparatus includes a casing having a main body front wall and an upper wall. The main body front wall has a front cover. The front cover is openable and closable relative to the casing with a lower edge side serving as a fulcrum. The upper wall has a central portion and a front edge portion. The front edge portion is openable so as to stand up on a front side of the central portion. The front edge portion is openable after the front cover has been opened. In the above-mentioned image forming apparatus, the front cover and the front edge portion are opened for jam removal, for example.

SUMMARY

An image forming apparatus according to the present disclosure includes an image forming section, a casing, and an open-close section. The image forming section forms an image on a recording medium. The casing internally houses the image forming section. The casing includes a first opening and a second opening. The first opening is formed in a side surface of the casing. The second opening is formed in an upper surface of the casing. The open-close section includes a first cover, a second cover, and an interlocking section. The first cover includes a first cover main body that opens and closes the first opening. The second cover includes a second cover main body that opens and closes the second opening. The interlocking section opens the second cover main body as the first cover main body is opened.

DETAILED DESCRIPTION

An embodiment of the present disclosure will be described as follows reference to the drawings. However, the present disclosure is not limited to the following embodiment. Note that elements within the drawings that are the same or equivalent will be referred to with the same reference numbers and description thereof will not be repeated.

Figure 1:
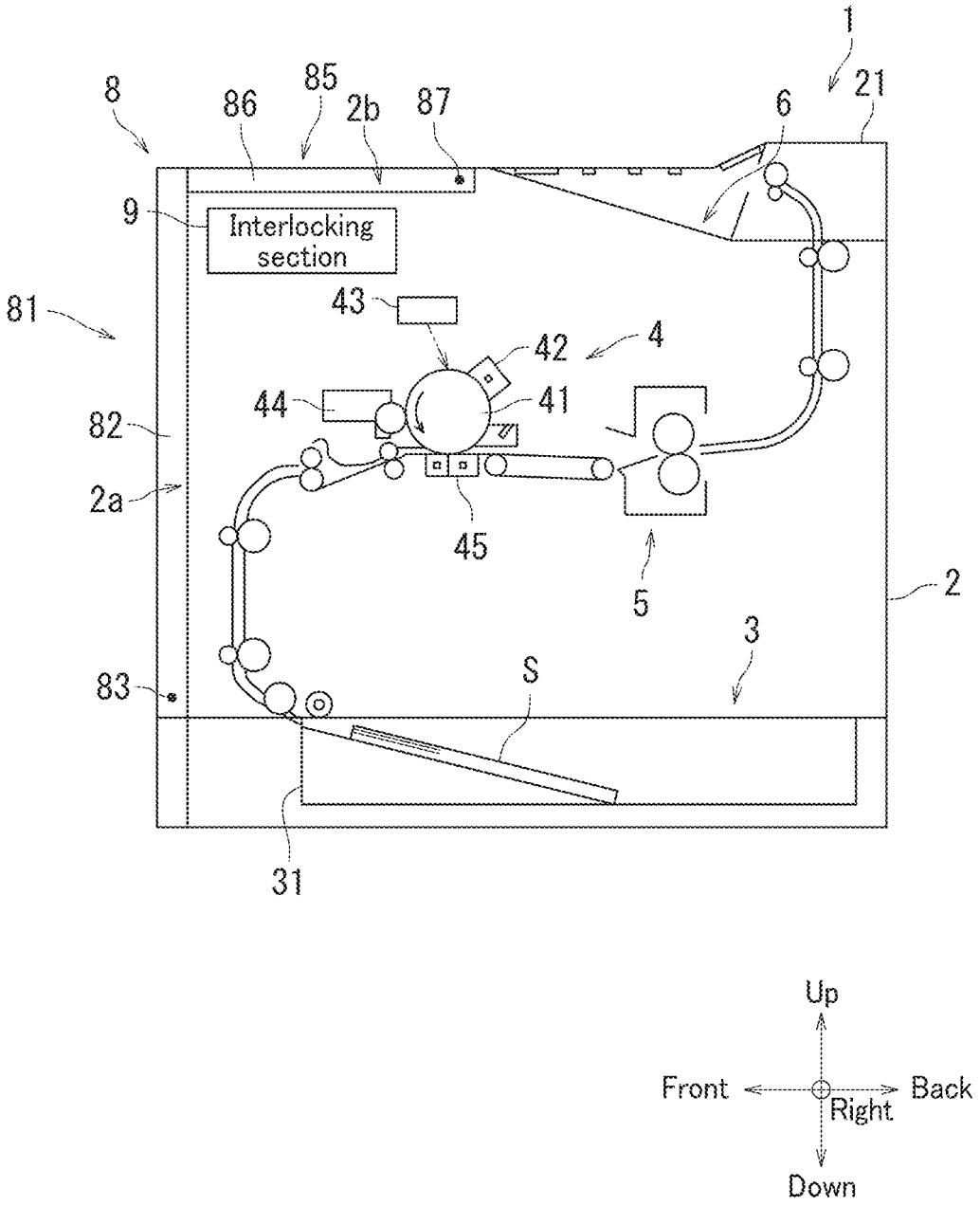
FIG. 1 is a diagram illustrating a configuration of an image forming apparatus according to an embodiment of the present disclosure.

An image forming apparatus 1 according to the embodiment of the present disclosure will be described with reference to FIG. 1. FIG. 1 is a diagram illustrating a configuration of the image forming apparatus 1 according to the present embodiment. As illustrated in FIG. 1, the image forming apparatus 1 is a printer. The image forming apparatus 1 forms an image on a sheet S.

The sheet S is an example of a recording medium according to the present disclosure. Examples of the sheet S include plain paper, copy paper, recycled paper, thin paper, thick paper, glossy paper, and overhead projector (OHP) transparency.

The image forming apparatus 1 includes a casing 2, a sheet feed section 3, an image forming section 4, a fixing section 5, an exit table 6, and an open-close section 8. The casing 2 is box-shaped. The casing 2 internally houses the sheet feed section 3, the image forming section 4, and the fixing section 5.

The casing 2 includes a first opening 2*a*, a second opening 2*b*, and an upper surface portion 21. The exit table 6 is formed in the upper surface portion 21. In FIG. 1, a side of the image forming apparatus 1 on which the first opening 2*a* is located is defined as front of the image forming apparatus 1, thus defining a front-back direction. A side of the image forming apparatus 1 that is left when the image forming apparatus 1 is viewed in a direction from the front is defined as left of the image forming apparatus 1, thus defining a left-right direction. A direction that is orthogonal to both the front-back direction and the left-right direction is defined as an up-down direction.

According to the present embodiment, the first opening 2*a* is formed in a front surface (side surface in front) of the casing 2. The second opening 2*b* is formed in an upper surface of the casing 2. In detail, the second opening 2*b* is formed in the upper surface of the casing 2, in the front of the upper surface portion 21. The second opening 2*b* is connected to the first opening 2*a*.

The sheet feed section 3 feeds the sheet S. The sheet feed section 3 includes a sheet feed cassette 31. The sheet feed cassette 31 is located in a lower edge portion of the casing 2. The sheet feed cassette 31 is attachable to and detachable from the casing 2. The sheet feed cassette 31 may house a plurality of sheets S. The sheet feed section 3 feeds the sheets S housed in the sheet feed cassette 31 a sheet at a time.

The image forming section 4 includes an image bearing member 41, a charger 42, an exposure section 43, a developing section 44, and a transfer section 45. The image forming section 4 forms a toner image on the sheet S fed from the sheet feed section 3. The fixing section 5 fixes the toner image to the sheet S. The sheet S with the toner image fixed thereon is fed to the exit table 6.

The open-close section 8 is openable and closeable relative to the casing 2. The open-close section 8 covers the first opening 2*a* and the second opening 2*b*. The open-close section 8 includes a first cover 81, a second cover 85, and an interlocking section 9.

The first cover 81 is located on the front surface of the casing 2. The first cover 81 is located on the front surface of the casing 2 in a higher position than the sheet feed cassette 31. The first cover 81 includes a first cover main body 82 and a first shaft 83.

The first cover main body 82 opens and closes the first opening 2*a*. The first cover main body 82 is plate-shaped.

The first shaft 83 is provided in a lower edge portion of the first cover main body 82. The first shaft 83 is pivotably supported by the casing 2. The first cover main body 82 is pivotable around the first shaft 83. The first cover main body 82 opens and closes the first opening 2*a* by pivoting around the first shaft 83. In the following, a position of the first cover main body 82 when the first opening 2*a* is open is referred to as a "first open position". A position of the first cover main body 82 when the first opening 2*a* is closed is referred to as a "first closed position".

The second cover 85 is located on the upper surface of the casing 2. The second cover 85 is located on the upper surface of the casing 2 in front of the exit table 6. The second cover 85 includes a second cover main body 86 and a second shaft 87.

The second cover main body 86 opens and closes the second opening 2*b*. The second cover main body 86 is plate-shaped. The second shaft 87 is provided in a back edge portion of the second cover main body 86. The second shaft 87 is pivotable supported by the casing 2. The second cover main body 86 is pivotable around the second shaft 87. The second cover main body 86 opens and closes the second opening 2*b* by pivoting around the second shaft 87. In the following, a position of the second cover main body 86 when the second opening 2*b* is open is referred to as a "second open position". A position of the second cover main body 86 when the second opening 2*b* is closed is referred to as a "second closed position".

When the first cover main body 82 is in the first closed position and the second cover main body 86 is in the second closed position, a front surface of the second cover main body 86 faces an upper edge portion of a back surface of the first cover main body 82. In detail, the front surface of the second cover main body 86 makes contact with the upper edge portion of the back surface of the first cover main body 82.

The interlocking section 9 moves (opens) the second cover main body 86 from the second closed position to the second open position when the first cover main body 82 moves (is opened) from the first closed position to the first open position. In other words, the interlocking section 9 opens the second opening 2*b* when the first opening 2*a* is opened. The interlocking section 9 also holds the second cover 85 open when the first cover 81 is open. In other words, the interlocking section 9 holds the second opening 2*b* open when the first opening 2*a* is open.

In the image forming apparatus 1 according to the present embodiment, the interlocking section 9 opens the second cover main body 86 in conjunction with the motion of the first cover main body 82 as the first cover main body 82 opens. Accordingly, a user can perceive that the upper surface (second cover main body 86) of the casing 2 is openable. In detail, according to the present embodiment, the interlocking section 9 puts the second cover main body 86 in an inclined posture relative to the upper surface of the casing 2 when the first cover main body 82 is opened. For example, the interlocking section 9 inclines the second cover main body 86 at 45° relative to the upper surface of the casing 2.

Figure 2:
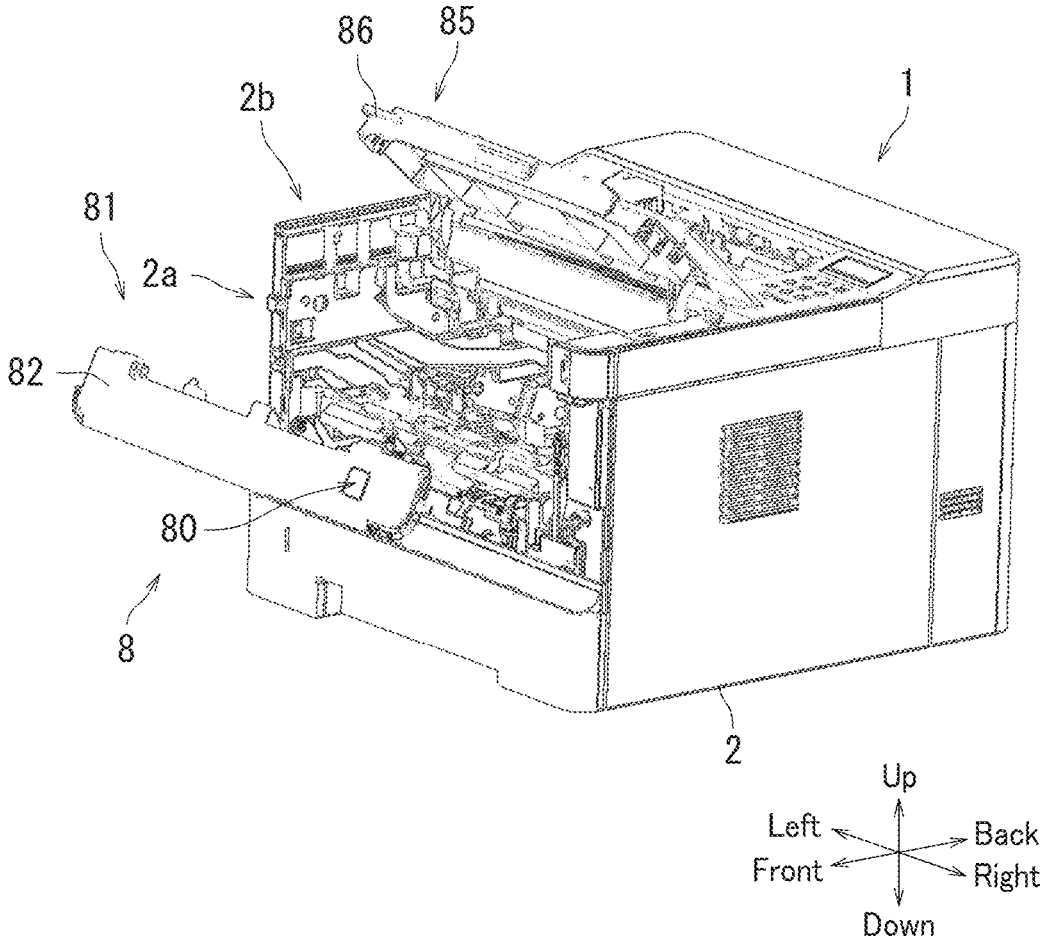
FIG. 2 is a perspective view illustrating the image forming apparatus according to the embodiment of the present disclosure.

Next, opening and closing movement of the first cover main body 82 will be described with reference to FIG. 2. FIG. 2 is a perspective view illustrating the image forming apparatus 1. In detail, FIG. 2 illustrates the first cover main body 82 and the second cover main body 86 in an open state.

As illustrated in FIG. 2, the first cover main body 82 can move (open) from the first closed position illustrated in FIG. 1 to the first open position illustrated in FIG. 2. The first cover main body 82 covers the first opening 2*a* when the first cover main body 82 is in the first closed position. The first cover main body 82 opens the first opening 2*a* when the first cover main body 82 is in the first open position.

The second cover main body 86 covers the second opening 2*b* when the second cover main body 86 is in the second closed position. The second cover main body 86 opens the second opening 2*b* when the second cover main body 86 is in the second open position. According to the present embodiment, the interlocking section 9 opens the second cover main body 86 to the second open position.

The open-close section 8 further includes a release button 80. When the first cover main body 82 is in the first closed position and the user operates the release button 80, the first cover main body 82 is opened. In detail, the casing 2 includes an engaging section and a pushing section. The engaging section engages the first cover main body 82 when the first cover main body 82 is in the first closed position. The pushing section pushes the first cover main body 82 forward when the first cover main body 82 is in the first closed position. When the user operates the release button 80, the first cover main body 82 and the engaging section are released from engagement. As a result, the pushing section opens the first cover main body 82.

The first cover main body 82 opens by moving due to the weight thereof to the first open position when opened by the pushing section. Accordingly, when the user operates the release button 80, the first cover main body 82 is opened and the second cover main body 86 is also opened in conjunction with the first cover main body 82. Therefore, the user can easily open the first cover main body 82 and the second cover main body 86.

Figure 3:
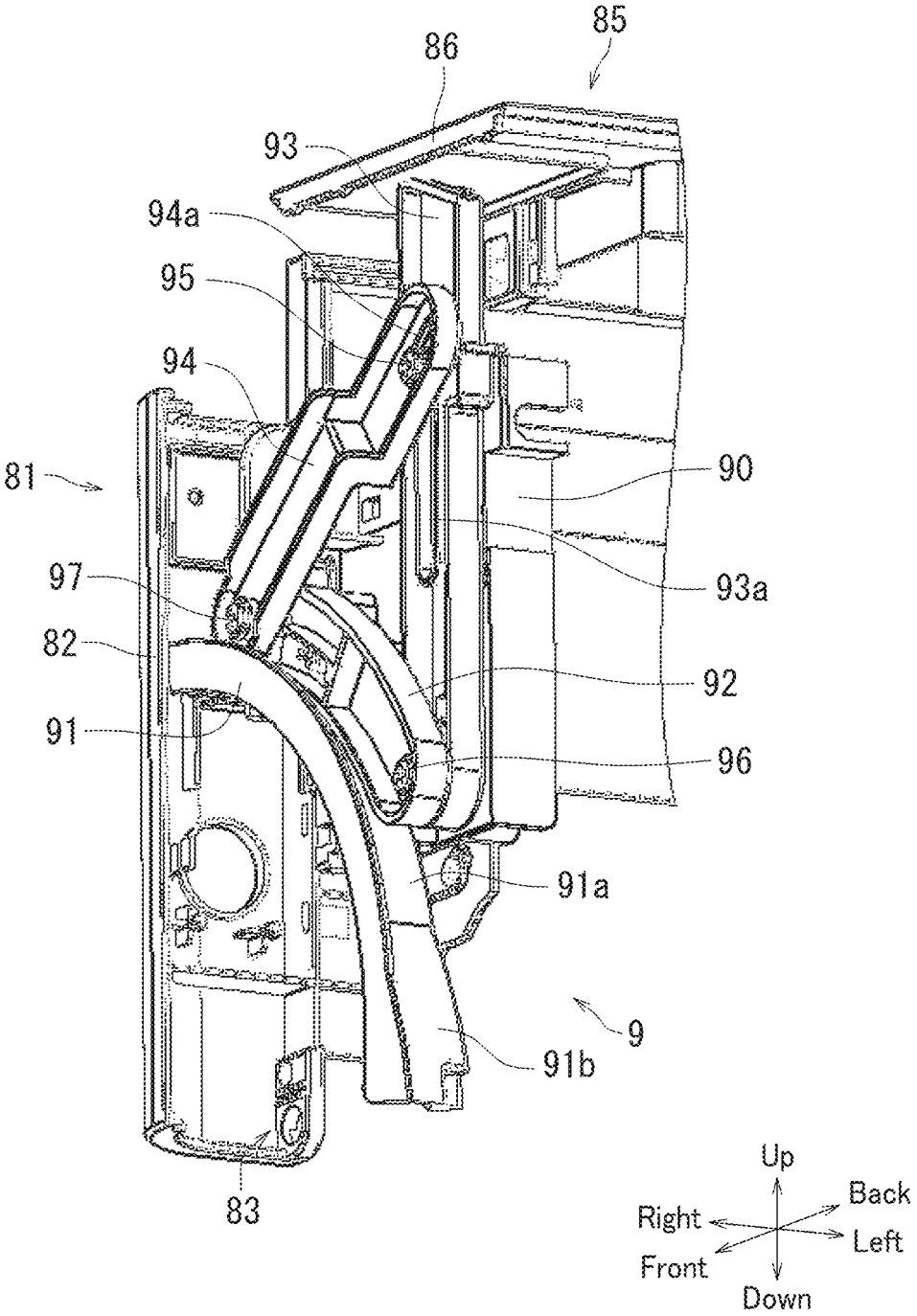
FIG. 3 is a perspective view illustrating an interlocking section according to the embodiment of the present disclosure.

Next, a configuration of the interlocking section 9 will be described with reference to FIG. 3. FIG. 3 is a perspective view illustrating the interlocking section 9. In detail, FIG. 3 is a diagram in which a right side surface of the interlocking section 9 is viewed from the back.

As illustrated in FIG. 3, the interlocking section 9 includes a main body section 90, a first link strip 91, a second link strip 92, a third link strip 93, a fourth link strip 94, a fixed shaft 95, a first movable shaft 96, and a second movable shaft 97. The main body section 90 is fixed to the casing 2. The fixed shaft 95 is fixed to the main body section 90.

The first link strip 91 connects to the first cover main body 82. In detail, the first link strip 91 is fixed to the back surface of the first cover main body 82. The first link strip 91 extends into the casing 2 from the first cover main body 82. The first link strip 91 is arc-shaped and partially encircles the first shaft 83 when viewed from the side. When the first cover main body 82 is in the first closed position, the first link strip 91 extends backward and downward from the back surface of the first cover main body 82 so as to trace an arc.

The first link strip 91 includes a support surface 91*a*. The support surface 91*a* is on an upper surface of the first link strip 91. The support surface 91*a* is arc-shaped and concentric to the first shaft 83.

The first link strip 91 further includes a protrusion 91*b*. The protrusion 91*b* is formed on a back end of the first link strip 91. In other words, the protrusion 91*b* is provided on an opposite end of the first link strip 91 from an end connected to the first cover main body 82. The protrusion 91*b* protrudes from the support surface 91*a*. In detail, the protrusion 91*b* protrudes outward from the support surface 91*a* in a radial direction of the support surface 91*a*. The protrusion 91*b* is arc-shaped when viewed from the side. The protrusion 91*b* smoothly connects to the support surface 91*a*. As the first cover main body 82 is opened and the first link strip 91 turns about the first shaft 83, the protrusion 91*b* ascends.

The first link strip 91 supports the second link strip 92 from beneath. In detail, at least one of the support surface 91*a* and the protrusion 91*b* of the first link strip 91 supports the second link strip 92 from beneath. The second link strip 92 is arc-shaped corresponding to the arc shape of the support surface 91*a* when viewed from the side. The second link strip 92 is slidable along the support surface 91*a* and the protrusion 91*b*. In detail, the second link strip 92 includes the first movable shaft 96 (an example of a movable shaft) and the second movable shaft 97. The first movable shaft 96 is provided in a back end of the second link strip 92. The first movable shaft 96 is movable in the up-down direction. The second movable shaft 97 is provided in a front end of the second link strip 92. The second movable shaft 97 is movable along the support surface 91*a* and the protrusion 91*b*. The second link strip 92 is slidable with the first movable shaft 96 and the second movable shaft 97 serving as fulcrums. As the first cover main body 82 is opened, the second link strip 92 mounts the protrusion 91*b* after sliding along the support surface 91*a*. Thereafter, the second link strip 92 slides along the protrusion 91*b*. The back end (first movable shaft 96) of the second link strip 92 is elevated by the protrusion 91*b* as the second link strip 92 mounts the protrusion 91*b*. In other words, the first movable shaft 96 is elevated by the protrusion 91*b* as the first cover main body 82 is opened.

The third link strip 93 extends in the up-down direction. The third link strip 93 connects to the second cover main body 86. According to the present embodiment, an upper end of the third link strip 93 is in contact with the second cover main body 86. The third link strip 93 includes an opening 93*a*. The opening 93*a* is formed in a central portion of the third link strip 93 in the up-down direction. The opening 93*a* extends in the up-down direction. The fixed shaft 95 is inserted into the opening 93*a*. As described above, the fixed shaft 95 is fixed to the main body section 90. Accordingly, the third link strip 93 is supported by the main body section 90 through the fixed shaft 95 so as to move in an extending direction of the opening 93*a* (up-down direction).

A lower end of the third link strip 93 pivotably supports the first movable shaft 96. Herewith, the lower end of the third link strip 93 connects to the back end of the second link strip 92 through the first movable shaft 96. Accordingly, the third link strip 93 ascends together with the back end (first movable shaft 96) of the second link strip 92 as the first cover main body 82 is opened. As the third link strip 93 ascends, the upper end of the third link strip 93 pushes the second cover main body 86 upward. As a result, the second cover main body 86 opens.

The fourth link strip 94 restricts a movement direction of the third link strip 93 to the up-down direction. Specifically, the fourth link strip 94 extends toward the second movable shaft 97 from the fixed shaft 95. In detail, the fourth link strip 94 includes an opening 94*a* formed in a back end (an end toward the fixed shaft 95) thereof. The opening 94*a* extends in an extending direction of the fourth link strip 94. The fixed shaft 95 is inserted into the opening 94*a* of the fourth link strip 94. Herewith, the fourth link strip 94 is supported by the main body section 90 through the fixed shaft 95. In detail, the fourth link strip 94 is movably supported by the fixed shaft 95 in the extending direction of the opening 94*a*. A front end (an end toward the second movable shaft 97) of the fourth link strip 94 pivotably supports the second movable shaft 97. Accordingly, the front end of the fourth link strip 94 is connected to the front end of the second link strip 92 through the second movable shaft 97.

Figure 4:
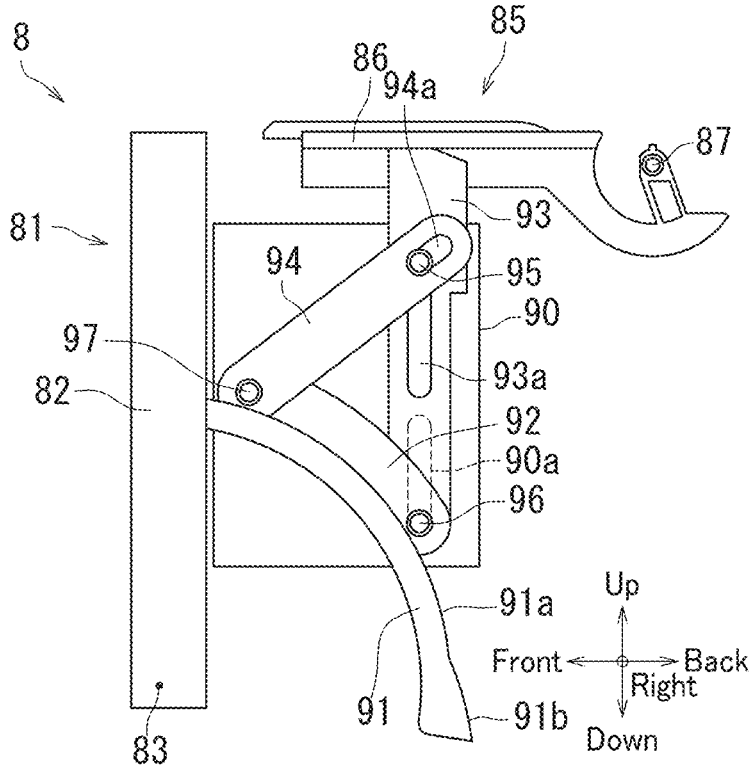
FIG. 4 is a side view illustrating an open-close section according to the embodiment of the present disclosure.

Next, the configuration of the main body section 90 will be further described with reference to FIG. 4. FIG. 4 is a side view illustrating the open-close section 8. As illustrated in FIG. 4, a guide groove 90*a* is formed extending in the up-down direction in a lower portion of the main body section 90. An end of the first movable shaft 96 is inserted into the guide groove 90*a*. The first movable shaft 96 is movable in the up-down direction along the guide groove 90*a*.

Figure 5:
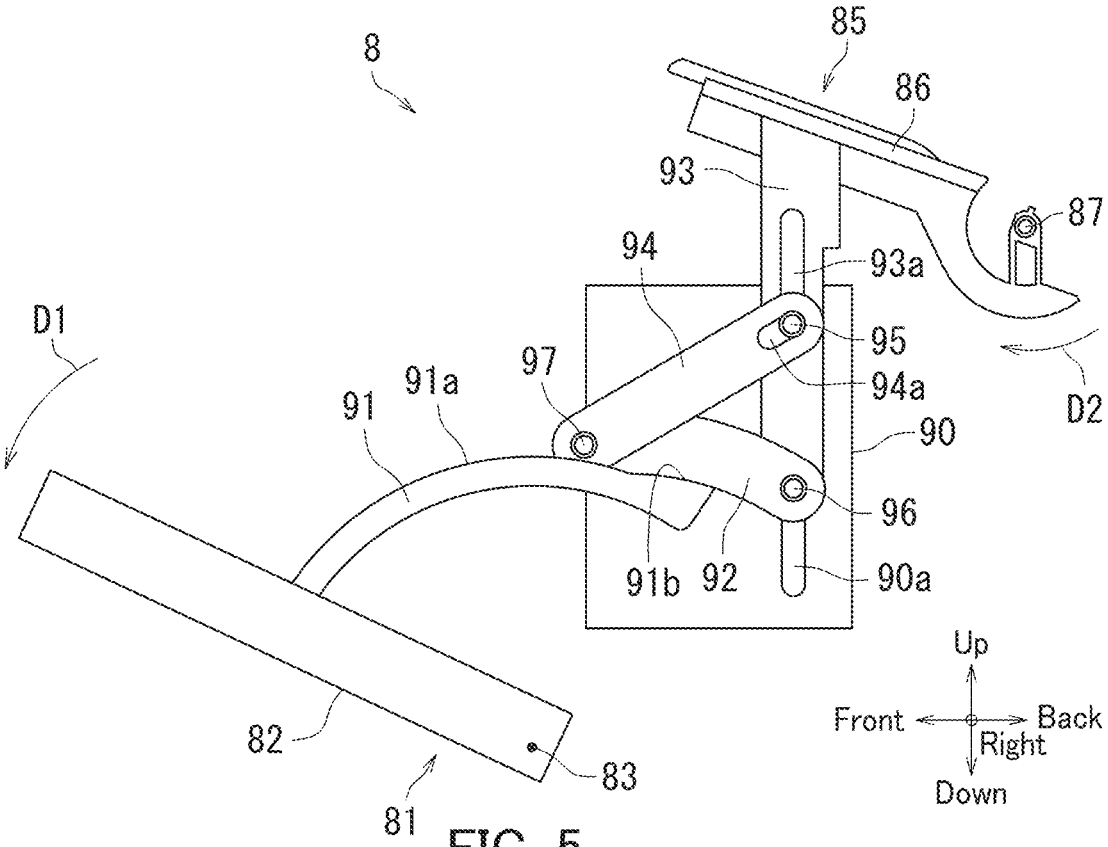
FIG. 5 is another side view illustrating the open-close section according to the embodiment of the present disclosure.

Next, opening and closing movement of the first cover main body 82 and the second cover main body 86 will be described with reference to FIGS. 4 and 5. FIG. 5 is a side view illustrating the open-close section 8. In detail, FIG. 4 illustrates the open-close section 8 with the first cover main body 82 in the first closed position and the second cover main body 86 in the second closed position. FIG. 5 illustrates the open-close section 8 with the first cover main body 82 in the first open position and the second cover main body 86 in the second open position.

As illustrated in FIG. 4, the protrusion 91*b* of the first link strip 91 is at the lowest position thereof when the first cover main body 82 is in the first closed position and the second cover main body 86 is in the second closed position. The support surface 91*a* of the first link strip 91 supports the second link strip 92 spanning a front end and a central portion of the first link strip 91.

An arrow D1 illustrated in FIG. 5 indicates an opening direction of the first cover main body 82. An arrow D2 illustrated in FIG. 5 indicates an opening direction of the second cover main body 86. As illustrated in FIG. 5, the front end of the first link strip 91 moves forward when the first cover main body 82 is opened as indicated by the arrow D1 from the first closed position. Herewith, the first link strip 91 turns about the first shaft 83. As the first link strip 91 turns about the first shaft 83, the second link strip 92 slides along the support surface 91*a* and a portion of the second link strip 92 supported by the first link strip 91 mounts the protrusion 91*b*. When the second link strip 92 mounts the protrusion 91*b*, the back end (first movable shaft 96) of the second link strip 92 ascends, and the third link strip 93 ascends. As a result, the upper end of the third link strip 93 pushes the second cover main body 86 upward, and the second cover main body 86 moves as indicated by the arrow D2 from the second closed position to the second open position. In other words, the second cover main body 86 opens.

According to the present embodiment, the second cover main body 86 when in the second open position inclines at an acute angle relative to the second cover main body 86 when in the second closed position. Typically, the second cover main body 86 when in the second open position inclines at an angle of 45° relative to the second cover main body 86 when in the second closed position. Accordingly, the user can perceive that the second cover main body 86 is openable by opening the first cover main body 82.

Figure 6A:
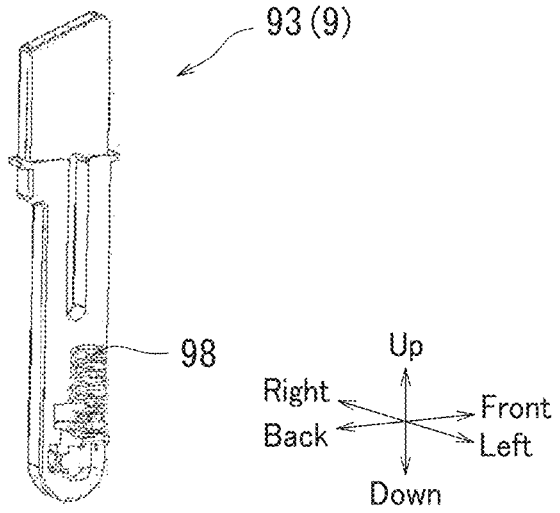
FIG. 6A is a diagram illustrating a left side surface of a third link strip according to the embodiment of the present disclosure.
Figure 6B:
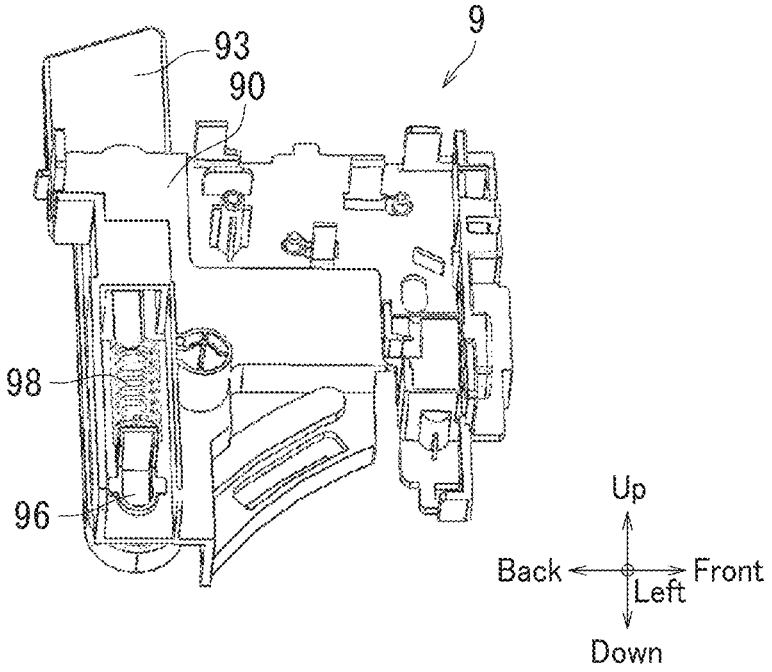
FIG. 6B is a diagram illustrating left side surfaces of a main body section and the third link strip according to the embodiment of the present disclosure.

Next, the interlocking section 9 will be further described with reference to FIGS. 6A and 6B. FIG. 6A is a diagram illustrating a left side surface of the third link strip 93. FIG. 6B is a diagram illustrating left side surfaces of the main body section 90 and the third link strip 93.

As illustrated in FIGS. 6A and 6B, the interlocking section 9 further includes an elastic member 98. The elastic member 98 is fixed to the lower end of the third link strip 93.

The elastic member 98 extends upward from the lower end of the third link strip 93. The elastic member 98 is a spring, for example.

When the third link strip 93 moves upward relative to the main body section 90, an upper end of the elastic member 98 comes in contact with the main body section 90. As a result, the elastic member 98 is compressed between the main body section 90 and the third link strip 93. In the image forming apparatus 1 according to the present embodiment, the elastic member 98 is compressed between the main body section 90 and the third link strip 93 when the first cover 81 is opened. Accordingly, the elastic member 98 moderates the opening speed of the first cover 81. As a result, the interlocking section 9 can reduce impact shock to the image forming apparatus 1 when the first cover 81 is opened.

The image forming apparatus 1 according to the embodiment of the present disclosure has been described above with reference to FIGS. 1 to 6B. However, the present disclosure is not limited to the above-mentioned embodiment, and may be performed in various manners within a scope not departing from the gist thereof.

For example, according to the embodiment of the present disclosure, the second cover main body 86 opens by moving from the second closed position to the second open position. However, the present disclosure is not limited thereto. The second cover main body 86 may be opened further from the second open position. For example, the second cover main body 86 may be opened to an upright position. The user moves the second cover main body 86 to the upright position, for example. As a result, the open-close section 8 can be opened wider, and jam removal can be easily performed in the back of the casing 2, for example.

Note that the drawings are schematic, emphasizing elements of configuration for ease of understanding. Properties of the elements of configuration in the drawings such as thickness and length may differ from actual properties thereof to facilitate preparation of the drawings. Also, shapes and the like of the elements of configuration illustrated in the above embodiment are but one example and are not particularly limited. The elements of configuration may be variously altered within a scope not substantially departing from the effects of the present disclosure.

What is claimed is:

1. An image forming apparatus, comprising:

an image forming section configured to form an image on a recording medium;

a casing configured to internally house the image forming section; and an open-close section, wherein the casing includes a first opening formed in a side surface of the casing and a second opening formed in an upper surface of the casing, and the open-close section includes:

a first cover including a first cover main body that opens and closes the first opening;

a second cover including a second cover main body that opens and closes the second opening; and an interlocking section configured to open the second cover main body as the first cover main body is opened, the first cover further includes a first shaft located in a lower edge portion of the first cover main body, the second cover further includes a second shaft, the second shaft is located in an edge portion of the second cover main body away from the first cover, when the first cover main body is in a first closed position for covering the first opening and the second cover main body is in a second closed position for covering the second opening, an end surface of the second cover main body toward the first cover faces the first cover main body, the interlocking section includes a first link strip, a second link strip, and a third link strip, the first link strip extends into the casing from the first cover main body, the second link strip is slidably supported by the first link strip, the third link strip connects to the second link strip and is movable in an up-down direction, the first link strip raises the second link strip and the third link strip when the first cover main body moves from the first closed position to a first open position in which the first cover main body opens the first opening, and when ascending, the third link strip pushes the second cover main body upward and moves the second cover main body from the second closed position to a second open position in which the second cover main body opens the second opening.

2. The image forming apparatus according to claim 1, wherein the first link strip includes an arc-shaped support surface supporting the second link strip, and the second link strip slides along the support surface.

3. The image forming apparatus according to claim 2, wherein the first link strip further includes a protrusion protruding outward from the support surface in a radial direction of the support surface, the support surface and the protrusion are located on an upper surface of the first link strip, and the protrusion smoothly connects to the support surface.

4. The image forming apparatus according to claim 1, wherein the interlocking section further includes a fourth link strip connected to the second link strip and the third link strip, and the fourth link strip restricts a movement direction of the third link strip to the up-down direction.

5. The image forming apparatus according to claim 1, wherein the first opening is connected to the second opening.

6. An image forming apparatus, comprising:

an image forming section configured to form an image on a recording medium;

a casing configured to internally house the image forming section; and an open-close section, wherein the casing includes a first opening formed in a side surface of the casing and a second opening formed in an upper surface of the casing, and the open-close section includes:

a first cover including a first cover main body that opens and closes the first opening;

a second cover including a second cover main body that opens and closes the second opening; and an interlocking section configured to open the second cover main body as the first cover main body is opened, the first cover further includes a first shaft located in a lower edge portion of the first cover main body, the second cover further includes a second shaft, the second shaft is located in an edge portion of the second cover main body away from the first cover, when the first cover main body is in a first closed position for covering the first opening and the second cover main body is in a second closed position for covering the second opening, an end surface of the second cover main body toward the first cover faces the first cover main body, the interlocking section includes a first link strip, a second link strip, and a third link strip, the first link strip connects to the first cover main body and extends into the casing, the second link strip is supported from beneath by the first link strip and includes a movable shaft that is movable in an up-down direction, an end of the third link strip connects to the second cover main body, and an opposite end of the third link strip connects to the second link strip through the movable shaft, as the first cover main body pivots around the first shaft, the first link strip turns about the first shaft, as the first link strip turns about the first shaft, the third link strip ascends together with the movable shaft, and the second cover main body opens due to the ascending of the third link strip.

7. The image forming apparatus according to claim 6, wherein the first link strip includes a support surface and a protrusion, the first link strip is arc-shaped and partially encircles the first shaft, the protrusion protrudes outward from the support surface in a radial direction of the support surface, and the protrusion is provided on an opposite end of the first link strip from an end connected to the first cover main body.

8. The image forming apparatus according to claim 7, wherein the third link strip ascends due to the movable shaft mounting the protrusion.

* * * * *